US006913489B2

(12) United States Patent
Chai et al.

(10) Patent No.: US 6,913,489 B2
(45) Date of Patent: Jul. 5, 2005

(54) EXTERNAL HIGH FREQUENCY CONNECTOR

(75) Inventors: Chia-Yen Chai, Taipei Hsien (TW); Fu-Chen Chou, Taipei Hsien (TW); Pi-Ching Chen, Taipei Hsien (TW)

(73) Assignee: Comax Technology Inc., Taipei (TW)

( * ) Notice: Subject to any disclaimer, the term of this patent is extended or adjusted under 35 U.S.C. 154(b) by 0 days.

(21) Appl. No.: 10/760,289

(22) Filed: Jan. 21, 2004

(65) Prior Publication Data

US 2005/0085128 A1 Apr. 21, 2005

(30) Foreign Application Priority Data

Oct. 15, 2003 (TW) ..... 92218346 U

(51) Int. Cl.[7] ..... H01R 13/648
(52) U.S. Cl. ..... 439/607
(58) Field of Search ..... 439/607, 608, 439/609, 610, 934

(56) References Cited

U.S. PATENT DOCUMENTS 4,457,575 A * 7/1984 Davis et al. ..... 439/610
4,653,836 A * 3/1987 Peele ..... 439/610
5,199,903 A * 4/1993 Asick et al. ..... 439/610
5,380,223 A * 1/1995 Marsh et al. ..... 439/610
5,417,590 A * 5/1995 Dechelette et al. ..... 439/607
5,518,421 A * 5/1996 Davis ..... 439/607
6,007,385 A * 12/1999 Wu ..... 439/610
6,017,245 A * 1/2000 Karir ..... 439/610
6,059,607 A * 5/2000 Wilson ..... 439/610
6,109,969 A * 8/2000 Kuo et al. ..... 439/610
6,165,017 A * 12/2000 Kuo ..... 439/610
6,609,934 B2 * 8/2003 Chen et al. ..... 439/610
6,641,429 B1 * 11/2003 Wu ..... 439/465

* cited by examiner

*Primary Examiner*—Briggitte R. Hammond
(74) *Attorney, Agent, or Firm*—Troxell Law Office, PLLC

(57) ABSTRACT

An external high frequency connector has two side: one is the connecting side to connect to the corresponding connector, the other side is wiring side to connect to the end of high frequency cable to transmit electrical signals; the present invention comprises an insulating body containing a plurality of contacts, a metal shield wrapping the insulating body and an external packaging; a protruding part connecting to the electrical ground is on the connecting side of the metal shield, a positioner wedging the cables is on one side of the metal shield; the protruding part connects the electrical ground first to discharge electric charges and lift the transmission quality, form electromagnetic protection effect; the positioner can stabilize the cables and prevent the cables from sway for better overall mechanical strength.

4 Claims, 3 Drawing Sheets

EXTERNAL HIGH FREQUENCY CONNECTOR

BACKGROUND OF THE INVENTION

I. Field of the Invention

This invention relates generally to an external high frequency connector and, more specifically, to an external high frequency connector applied in electronic equipments.

II. Description of the Prior Art

Heretofore, it is known that in order to meet the requirement of high speed data transmission, data storage interface advances rapidly, such as Ultra ATA, Ultra ATA/66, Ultra ATA/100, Ultra ATA/133; in order to break the throughput bottleneck, now Serial ATA becomes the highest transmission standard. However, the faster the transmission speed, more problems need to face in the manufacturing technology.

Serial ATA changes the traditional parallel design to transmit data through a set of transmission pair. Based on current Serial ATA connection technology, this applicant submitted a No. 091220551 pattern application in Taiwan; the major component of above application included an insulating body, a metal shield and an external packaging, the metal shield had a cable positioning mechanism, the positioning mechanism had a cable fixing device to maintain cable position and lock the cables to prevent the cables from sway to lift the high frequency characters and strengthen the whole structure. However such technique remains following issues:

1) The fixing of cables is not reliable: the fixing device consists of fasteners and fastening holes, the tight or loose of cables is defined by the locations of the fasteners and fastening holes; if the manufacturing process is not accurate enough, the cables are not firmly fastened.
2) The electromagnetic field consideration: even though all the current high frequency transmission cables are shielded by metal electrical shelter, however, when current connectors connect to each other, the signal wires and ground wires are connected together at the same time, noise might generate to interfere signal transmission.

SUMMARY OF THE INVENTION

It is therefore a primary object of the present invention to provide an external high frequency connector that offers a connecting mechanism to discharge electric charges to electrical ground to lift the transmission quality and form electromagnetic protection effect.

It is still an object for the present invention to provide an external high frequency connector in which the cables can be positioned properly to avoid the bending and wrong position condition for better high frequency transmission character.

In order to achieve the objective set forth, an external high frequency connector in accordance with the present invention has two side, one is the connecting side to connect to the corresponding connector, the other side is wiring side to connect to the end of high frequency cable to transmit electrical signals; the present invention comprises an insulating body containing a plurality of contacts, a metal shield wrapping the insulating body and an external packaging; a protruding part connecting to the electrical ground is on the connecting side of the metal shield, a positioner wedging the cables is on one side of the metal shield; the protruding part connects the electrical ground first to discharge electric charges and lift the transmission quality, form electromagnetic protection effect; the positioner can stabilize the cables and prevent the cables from sway for better overall mechanical strength.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

Figure 3:
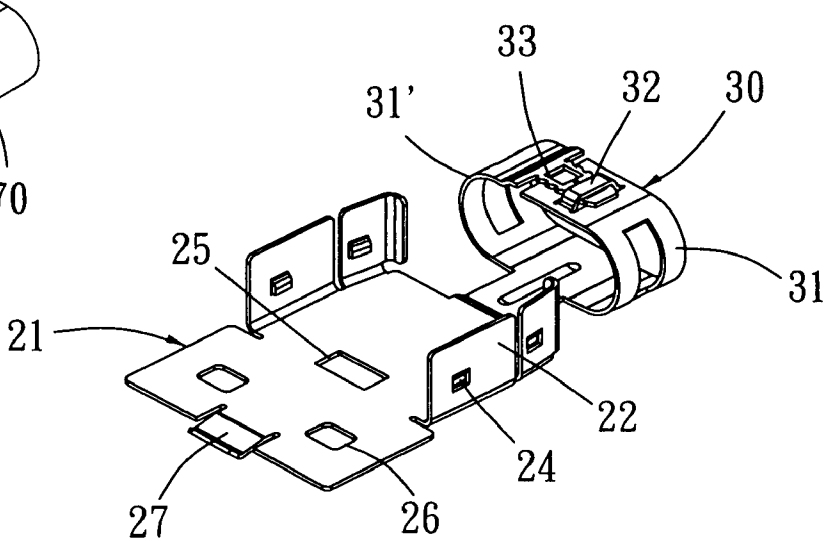
FIG. 3 is a perspective view of a further embodiment of the present invention.
Figure 1:
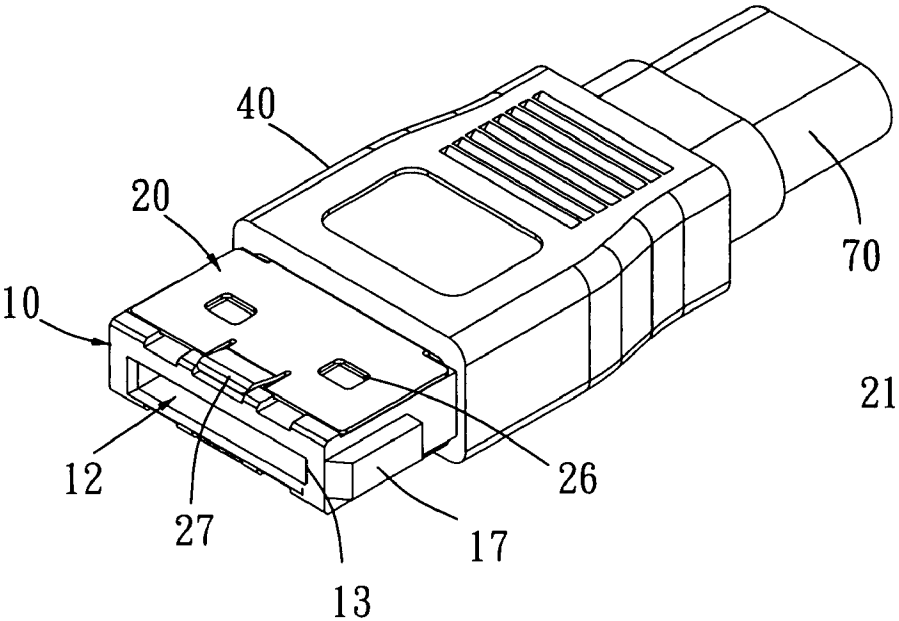
FIG. 1 is a perspective view of the present invention.
Figure 2:
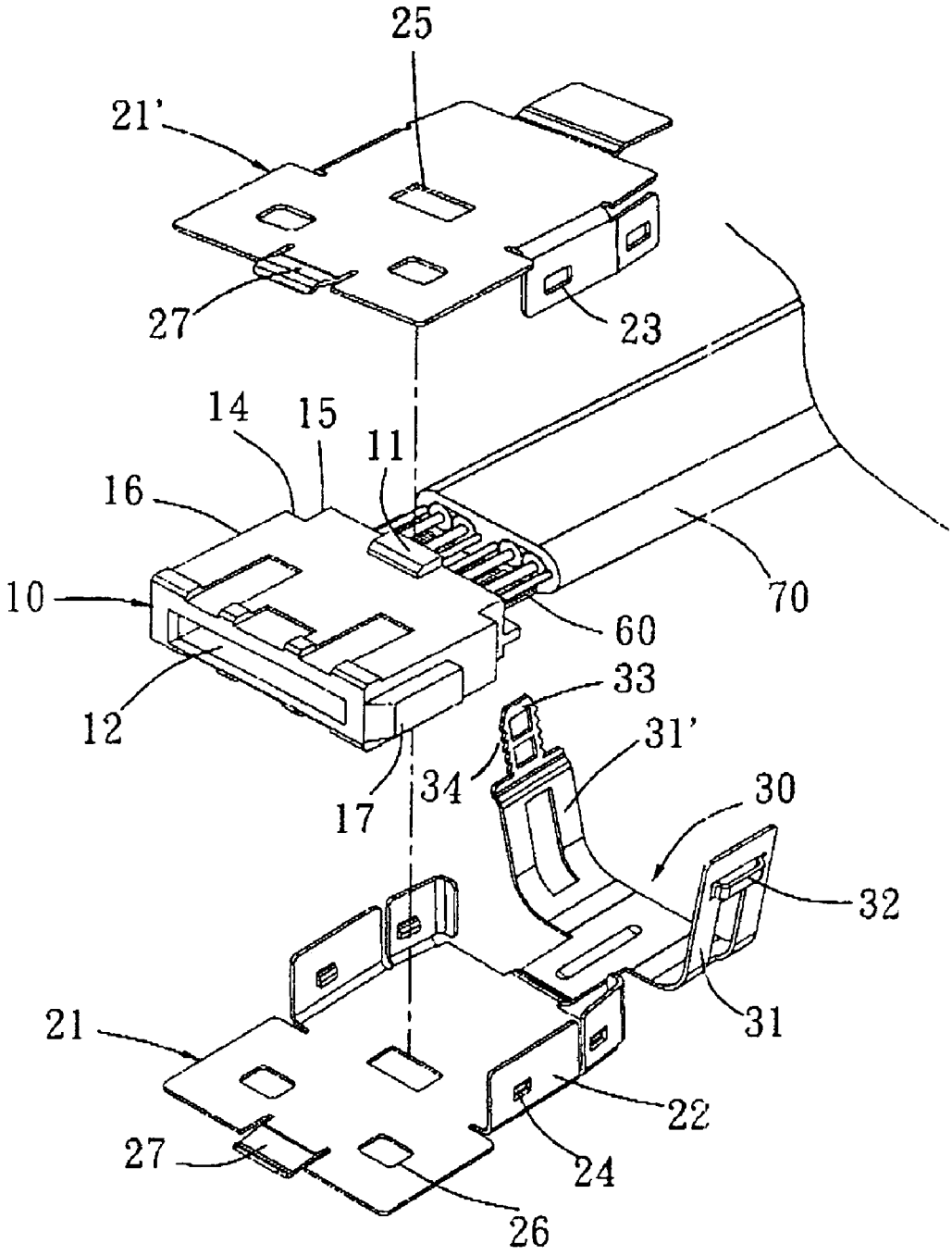
FIG. 2 is an assembly view of the present invention.

Referring to FIG. 1 and FIG. 2, the present invention has two side: one is the connecting side to connect to the corresponding connector, the other side is wiring side to connect to the end of high frequency cable 70 to transmit electrical signals; the present invention comprises an insulating body 10 containing a plurality of contacts 60, a metal shield 20 wrapping the insulating body 10 and an external packaging 40. The functions of each component are described below:

The plurality of contacts 60 inside the insulating body 10 are electrically connected to the cable 70, as shown in FIG. 3, a positioner 30 wedging the cable 70 is on one side of the metal shield 20; a protruding part 27 connecting to the electrical ground is on the connecting side of the metal shield 20, a positioner 30 wedging the cable 70 stretches out to the wiring side, the positioner 30 has two wedges 31, 31' that wrap the cable 70 vertically, a fastening hole 32 and a fastener 33 each is on the end of a wedge 31, 31', a teeth 34 each is on both sides of the fastener 33 for better fastening effect; the protruding part 27 of the metal shield 20 can discharge through the electrical ground to assure the high frequency transmission quality; the fastening hole 32 and the fastener 33 of the positioner 30 can stabilize the cable 70 and prevent the cable 70 from sway for better overall mechanical strength.

Figure 4:
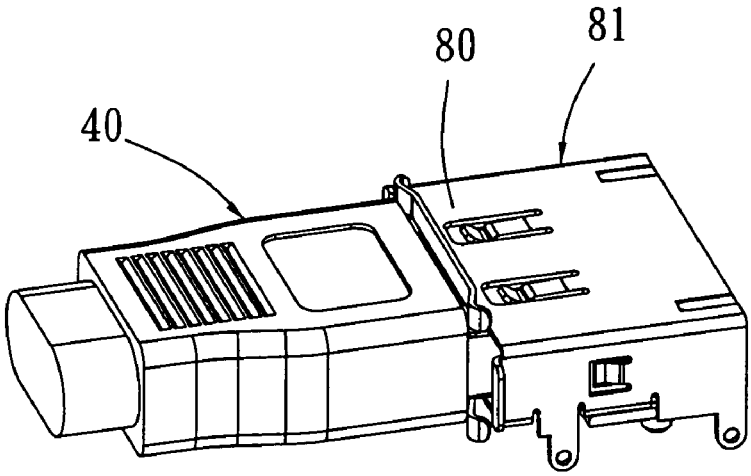
FIG. 4 is an application view of present invention.
Figure 5:
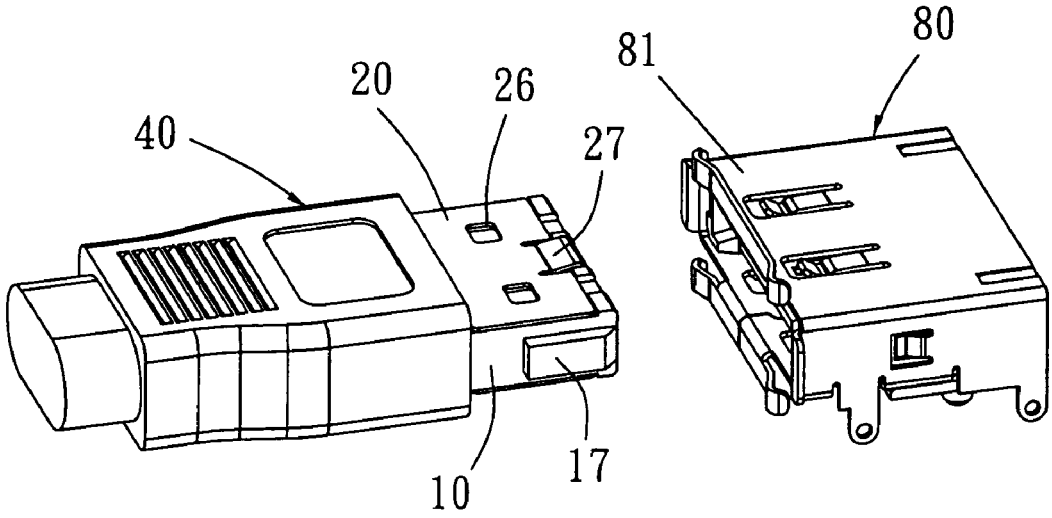
FIG. 5 is another application of present invention.

The insulating body 10 has a connecting slot 12 passing through the insulating body 10, the connecting slot 12 install the contacts 60 and has at least one convexities 11; the connecting side and the wiring side of the insulating body 10 are separated by a divider 14 into a connecting section 16 and a wiring section 15, a connecting hole 13 is a portion of the connecting slot 12 located in the connecting section 16, a guiding convex 17 is on one side of the connecting section 16, referring to FIG. 4 and FIG. 5, the connecting hole 13 on the connecting side form a corresponding connecting shape for the corresponding connector 80, the guiding convex 17 can identify the right connecting direction of the corresponding connector 80 to avoid wrong connection.

The metal shield 20 further consists of two metal bodies 21, 21', the positioner 30 is formed and stretches out from one of the metal bodies 21; 21' two sides of the metal bodies 21, 21' have sidewalls 22 corresponding to the insulating body 10, pairs of metal body fastening slots 23 and metal body fasteners 24 are on the sidewalls 22 to fix two metal bodies 21, 21' together, at least on through holes 25 corresponding to the convexities 11 of the insulating body 10 are on the metal bodies 21, 21', at least one gripping holes 26 corresponding to the corresponding connector 80 are on the metal bodies 21, 21' to increase the pulling difficulty.

The external packaging 40 covers the insulating body 10 from the divider 14 of the insulating body 10 toward the cable 70 and covers some portion of the insulating body 10 and the cable 70; the external packaging 40 is injected in one piece and wraps the convexities 11 passing through the through holes 25 of the metal shield 20 to stabilize the insulating body 10.

During manufacturing, the cable 70 are pull straight and soldered onto the contacts 60; the metal bodies 21, 21' and the insulating body 10 are combined with the convexities 11 of the metal bodies 21, 21' passing through the through holes 25 of the insulating body 10; at the same time, the metal body fasteners 24 on the sidewalls 22 of one metal body 21 fall into the metal body fastening slots 23 on the sidewalls 22 of another metal body 21' to have the metal bodies 21, 21' wrap firmly over the insulating body 10; referring to FIG. 2 and FIG. 3, the wedges 31, 31' of the positioner 30 of the metal bodies 21, 21' are bent along the diameter of the cable 70, the fastening hole 32 and the fastener 33 on the end of the wedges are fastened together, the combination of the teeth 34 and the fastening hole 32 can position the cable 70 and the metal shield 20 properly; finally the external packaging 40 is inject from the divider 14 of the insulating body 10 toward the cable 70 direction to finish the manufacturing process.

While application, referring to FIG. 4 and FIG. 5, a shelter 81 is installed externally to the corresponding connector 80, the connecting side of the insulating body 10 connects the corresponding connector 80, during insertion, the protruding part 27 of the metal shield 20 connects to the shelter 81 of the corresponding connector 80 first to discharge electric charges to electrical ground to lift the transmission quality and form electromagnetic protection effect; the gripping holes 26 on the metal bodies 21 can be fastened by the corresponding connector 80 to increase the pulling difficulty.

Therefore, the present invention provide an external high frequency connector in which the cables 70 can be positioned properly to avoid the bending by the positioner 30 and wrong position condition, and a protruding part 27 connecting to the electrical ground is on the connecting side of the metal shield 20 to electrical ground. The present invention provide lift the transmission quality, form electromagnetic protection effect; and better overall mechanical strength.

While a preferred embodiment of the present invention has been shown and described in detail, it will be readily understood and appreciated that numerous omissions, changes and additions may be made without departing from the spirit and scope of the present invention.

What is claimed is:

1. An external high frequency connector for connecting to a high frequency cable and a corresponding connector, the external high frequency connector comprising:

a) an insulating body having:

i) a wiring section having a plurality of contacts connected to the high frequency cable;

ii) a connecting section having a connecting hole;

iii) a divider located between the wiring section and the connecting section;

iv) a connecting slot extending through the wiring section and the connecting section, the connecting hole communicating with the connecting slot; and v) at least one convexity extending from a surface of the connecting section;

b) a metal shield encasing the insulating body and having:

i) first and second metal bodies, each of the first and the second metal bodies having a protruding part located on a first end, two side walls located between the first end and the second end, and at least one through hole, each of the at least one convexity inserted into one of the at least one through hole, each protruding part of the first and the second metal bodies engaging the corresponding connector;

ii) a pair of metal body fastening slots are located on each of the two side walls of the first metal body; and iii) a pair of metal body fasteners are located on each of the two side walls of the second metal body, each of the pair of metal body fasteners being inserted into one of the pair of metal body fastening slots;

c) a positioner located on a second end of one of the first and the second metal bodies and having:

i) a first wedge having a fastening hole; and ii) a second wedge having a fastener inserted into the fastening hole, the high frequency cable connected to the positioner; and d) external packaging located on an exterior of the insulating body, the cable and the metal shield, and extending from the divider to the cable.

2. The external high frequency connector according to claim 1, wherein the connecting section includes a guiding convex extending from an exterior side thereof and corresponding with the corresponding connector.

3. The external high frequency connector according to claim 1, wherein the fastener includes a plurality of teeth located on opposing sides thereof.

4. The external high frequency connector according to claim 1, wherein each of the first and the second metal bodies has at least one gripping hole engaging the corresponding connector.

* * * * *